US005088152A

United States Patent [19]

Downey

[11] Patent Number: 5,088,152

[45] Date of Patent: Feb. 18, 1992

[54] DOOR SECURITY TRACK

[75] Inventor: William L. Downey, Peru, Ill.

[73] Assignee: Schlage Lock Company, San Francisco, Calif.

[21] Appl. No.: 404,776

[22] Filed: Sep. 8, 1989

[51] Int. Cl.[5] ..... E05F 1/00

[52] U.S. Cl. ..... 16/80; 49/13

[58] Field of Search ..... 16/80, 71; 49/13, 14, 49/386, 274

[56] References Cited

U.S. PATENT DOCUMENTS 3,164,404 1/1965 Arnold ..... 49/386

4,334,388 6/1982 Kambic ..... 49/13

4,835,905 6/1989 Lasier et al. ..... 49/14

4,837,890 6/1989 Tully et al. ..... 16/71

4,876,764 10/1989 Teague, Jr. ..... 16/71

*Primary Examiner*—Kurt Rowan

*Assistant Examiner*—J. Miner

*Attorney, Agent, or Firm*—Walter C. Vliet

[57] ABSTRACT

A tamper proof security door track and position means such as a door closer or door position indicator wherein the track is fully enclosed in the door closed position and protected by a slide closure in the open position to prevent debris from entering the track.

11 Claims, 2 Drawing Sheets

DOOR SECURITY TRACK

BACKGROUND OF THE INVENTION

Door closers or door position analyzers and the like normally require a means of connecting the device to the door. Commonly, this is done through an arm or series of arms connected between the device and the door. Single arm devices typically require a device to accumulate linear translation at the attachment point. This is often provided by a track and roller arrangement. The door closer or analyzer is normally mounted to the door frame and the track is mounted on the door or vice versa. One problem associated with track devices is that they are capable of accumulating debris which may tend to jamb the track. In high security applications, debris may be intentionally deployed to prevent door operation. For this, and for the further reason of appearance, concealed door closing and analyzing devices have been developed which are concealed within the door frame or door body in the normally closed position. For example, see Rodseth, U.S. Pat. No. 4,016,381, and Kambic, U.S. Pat. No. 4,334,388. However, in this case the track remains exposed when the door is in the open position.

OBJECT OF THE INVENTION

It is an object of the present invention to provide a means for guarding or closing an exposed track.

It is a further object of this invention to provide a means for closing the track which is complimentary in relationship to the track to both close the track during an exposed period and to further provide means for expelling debris that may have otherwise entered the track during transition periods.

It is yet a further object of the present invention to assure the track is unobstructed in the closing direction to therefore allow the door to be reliably secured in the closed position.

It is yet a further object of the invention to provide an economic track assembly which is readily manufactured and reliable in use.

These and other objects are obtained in a linear translation device for use in door control operations comprising: an actuator having rotary output on an arm, said arm being slidingly coupled to an elongated track of generally U shaped cross section, a complimentary elongated slide coupled to said arm of generally rectangular shaped cross section in a complimentary sliding relationship with said track so as to form a sliding closure for said track, said slide being coupled to said actuating device as a means of accumulating linear translation and deploying said slide means as a security insert.

DETAILED DESCRIPTION OF THE PREFERRED EMBODIMENT

Figure 3:
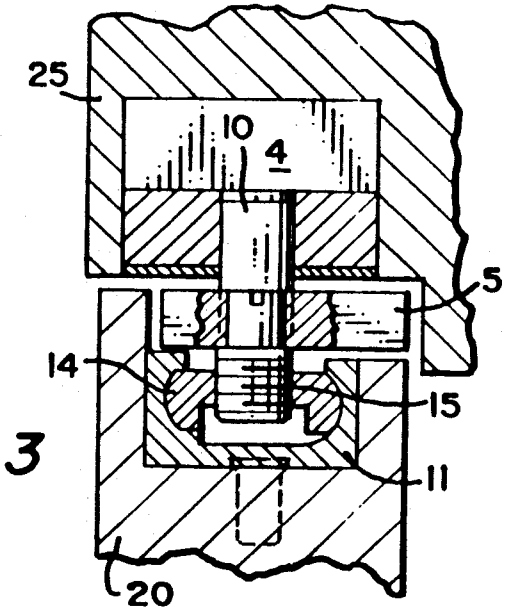
FIG. 3 is an end elevation of the device according to FIG. 1.
Figure 2:
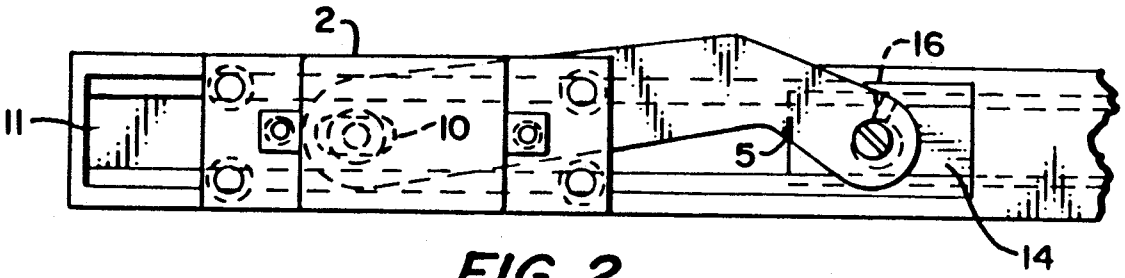
FIG. 2 is a plan view of the device according to FIG. 1.
Figure 1:
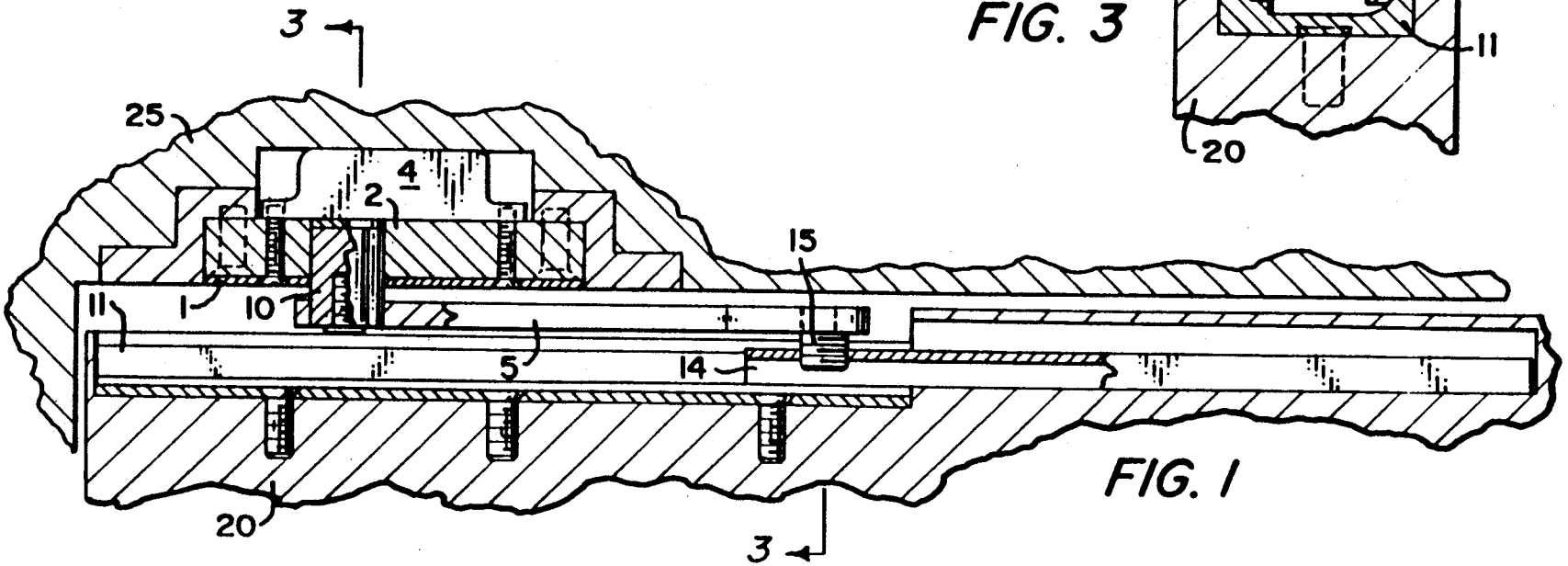
FIG. 1 is a side elevation view of a security track according to the present invention.

Referring to FIGS. 1, 2, and 3 a mounting block 2 is installed concealed in the frame 25 above (or below) a pivoted panel (for example, a door). A track 11 of general U shaped configuration is shown containing in sliding engagement an elongated slider 14 of generally inverted U shaped configuration. Both the track 11 and slider 14 are concealed in the pivoted panel 20 opposite the mounting block 2 (shown in FIGS. 1 and 3, and omitted for clarity from FIG. 2). The mounting block 2 supports a shaft 10 and a door monitoring device, such as a switch 4, or in the alternative, a door closing device (not shown) is attached to the shaft. The door closing device would, of course, simply replace the switch mechanism with a conventional door closer driving the door through the shaft 10. Shaft 10 is keyed to an arm 5 whose other end is rotatably connected to slider 14 through an eccentric stud 15.

Figure 4:
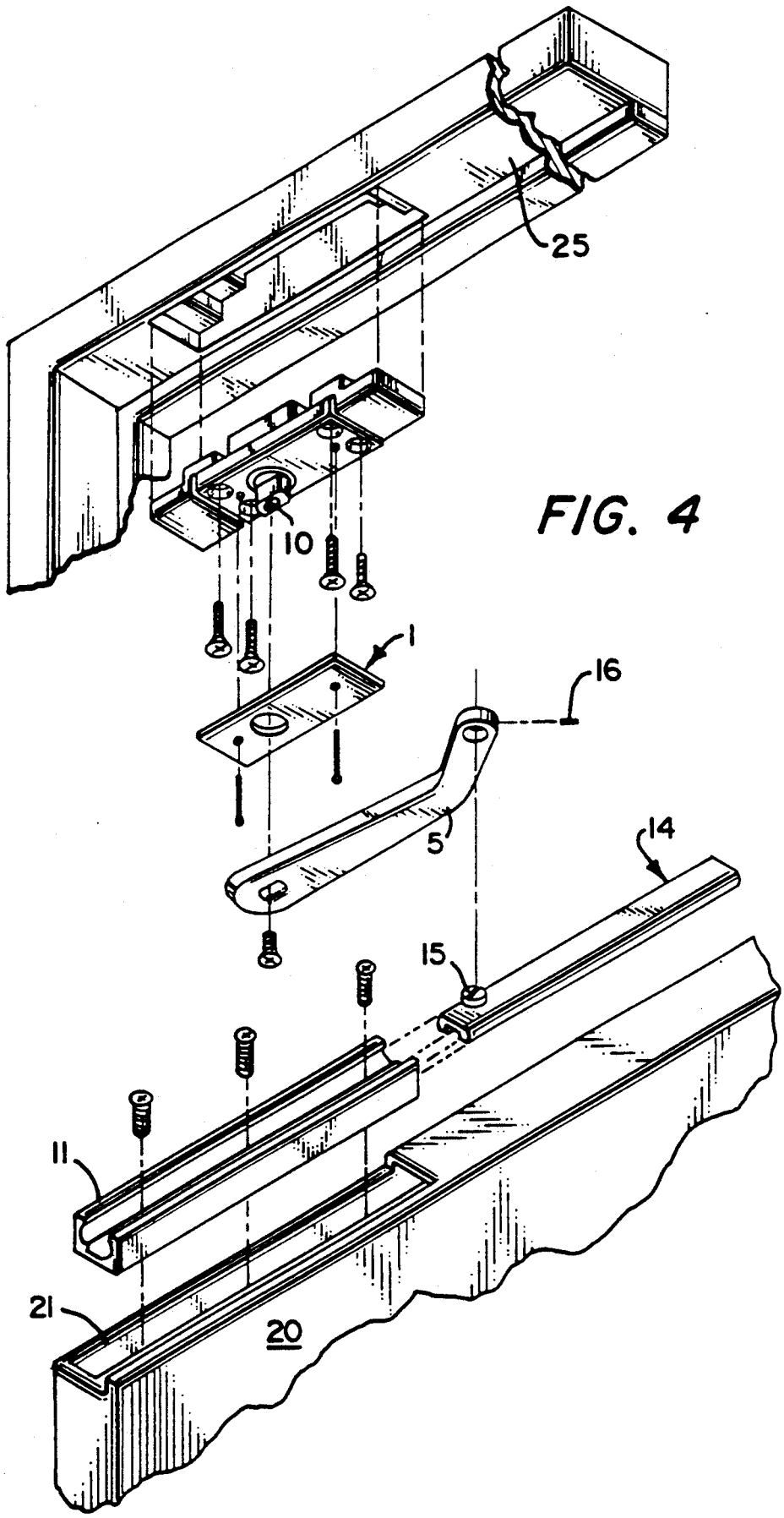
FIG. 4 is an isometric exploded view showing track assembly and installation in a door panel.

Arm 5 is therefore closely coupled to the door and remains essentially parallel with the door throughout the opening swing thereby minimizing its exposure and inhibiting vandalism. All of the parts are protected by being completely concealed within the frame or door when the door is closed. In the closed position, arm 5 recedes into a cutout pocket 21 of the door 20 best seen on FIG. 4. A finish plate 1 conceals the door position device 4 in the door frame 25. The cutout pocket in the door 21 by necessity exposes part of track 11 mortised into the door when the door is open.

To prevent a foreign object from being inserted into track 11 when the door is open (with the intent to prevent the door from closing), the outboard end of arm 5 is attached to slider 14. Slider 14 fills the otherwise open track. Slider 14 moves forward or back in the track as directed by arm 5 throughout the opening arc to the point where slider 14 fully closes the track 11 with the door in the full open position. As the door swings to the closed position the slider 14 is moved to the right as shown in FIG. 1 into the mortised pocket in the door and as the door is opened it is moved to the left as shown in FIG. 1 to fill the track.

As a further feature of the present invention arm 5 is attached to slider 14 through eccentric stud 15. This stud is locked to the arm with locking set screw 16 in the arm. When the set screw is loosened eccentric stud 15 may be rotated. The eccentric boss of stud 15 pivots or is rotatable in the slider 14. Because the slider is captured in track 11 and cannot move with respect to the width of the door the eccentric action of the rotating stud shifts the position of the end of arm 5 with respect to the width of slider 14, track 11, and the door. This lateral movement of the outboard end of arm 5 is converted to rotation of shaft 10 at the other end of the arm. A sensing device, such as a door position analyzer, may therefore be finally adjusted in that the position of arm 5 determines the shaft location relative to the door positioning device. This provides for a fine tuning option for on site adjustment, if necessary.

It should be understood that the slider and track have been described in terms of closely fitting upright and inverted U channel members, however, they may be a channel and flat plate, interacting slide or the like. In the preferred embodiment, the formed channels are of slightly curvilinear form in their contact area to assure alignment and retention of the slide within the track member.

Assembly screws are shown (particularly in FIG. 4) and are unnumbered. Their function should be obvious from the drawing to one skilled in the art.

Having described my invention in terms of a preferred embodiment, numerous modifications of the invention will occur to one skilled in the art. I, therefore, do now wish to be limited in the scope of my invention except as claimed.

I claim:

1. A linear translation track and track cover device for use with pivoted panel control apparatus having rotary output on an arm comprising:

an elongated track, slidingly coupled to the rotary output arm;

a complimentary elongated slide coupled to said arm in complimentary enclosing and sliding relationship with said track so as to form a closure of substantially all of said track when the pivoted panel is in an open position, said complimentary elongated slide being coupled to said rotary output arm as a means of accommodating linear translation of said rotary output arm relative to said elongated track and deploying said complimentary elongated slide means as a security cover.

2. A linear translation track and track cover device for use in pivoted panel control apparatus according to claim 1 wherein: said elongated track is of generally U shaped cross section, and said complimentary elongated slide is of a complimentary shape which closes said track in one deployed position.

3. A linear translation track and track cover device according to claim 2 wherein: said one deployed position is the panel open position.

4. A linear translation track and track cover device for use in pivoted panel control apparatus according to claim 1 wherein: said complimentary elongated slide is of generally rectangular cross section.

5. A linear translation track and track cover device for use in pivoted panel control apparatus according to claim 1 wherein: said elongated track and said complimentary elongated slide are each provided with complimentary arcuate side surfaces securing said complimentary elongated slide to said elongated track while permitting sliding axial engagement.

6. A linear translation track and track cover device for use in pivoted panel control apparatus according to claim 1 wherein: said pivoted panel comprises a door and the panel control apparatus further comprises a door closer.

7. A linear translation track and track cover device for use in pivoted panel control apparatus according to claim 1 wherein: said pivoted panel comprises a door and the panel control apparatus further comprises a door position indicating switch means.

8. A linear translation track and track cover device for use in pivoted panel control apparatus according to claim 1 wherein: said complimentary elongated slide is provided with an eccentric stud means as a means of accommodating fine adjustment of said linear translation device.

9. A linear translation track and track cover device for use in pivoted panel control means according to claim 8 wherein: said complimentary elongated track and said elongated slide and said adjustment means are concealed within the closed door so as not to be accessed by the public while said pivoted panel is in its closed position.

10. A linear translation track and track cover device for use with pivoted panel control apparatus having rotary output on an arm comprising:

an elongated track, slidingly coupled to the rotary output arm;

a complimentary elongated slide coupled to said arm in complimentary enclosing and sliding relationship with said track so as to form a closure of substantially all of said track when the pivoted panel is in an open position, said complimentary elongated slide being coupled to said rotary output arm as a means of accommodating linear translation of said rotary output arm relative to said elongated track and deploying said complimentary elongated slide means as a security cover, said elongated slide extends beyond said elongated track at least in part in a second position associated with a closed position of said pivoted panel and wherein said complimentary elongated slide is inserted in a complimentary pocket formed in said pivoted panel.

11. A linear translation device for use in door control operations comprising:

an actuator having rotary output on an arm, said arm being slidingly coupled to an elongated track of generally U-shape cross section;

a complimentary elongated slide coupled to said arm of generally rectangular shaped cross section in a complimentary sliding relationship with said elongated track so as to form a sliding closure means for said track, said complimentary elongated slide being coupled to said actuating device as a means for accumulating linear translation of said arm relative to said elongated track and deploying said slide means for denying access to substantially all of said elongated track.

* * * * *